United States Patent [19]

Vékony et al.

[11] Patent Number: 4,803,914

[45] Date of Patent: Feb. 14, 1989

[54] ROTATIONAL WORKING CYLINDER

[75] Inventors: Sándor Vékony; Klára J. Vékonyné, both of Miskolc, Hungary

[73] Assignee: Innofinance Altalanos Innovacios Penzintezet, Hungary

[21] Appl. No.: 927,057

[22] Filed: Nov. 4, 1986

[51] Int. Cl.[4] ..... F01B 3/00

[52] U.S. Cl. ..... 92/31; 92/84; 92/181 P; 74/441

[58] Field of Search ..... 92/31, 32, 33, 50, 69, 92/75, 84, 129, 181 P; 74/441; 91/233

[56] References Cited

U.S. PATENT DOCUMENTS

| | | | |
|---|---|---|---|
| 2,195,799 | 4/1940 | Parsons | 74/441 |
| 2,328,732 | 9/1943 | McKinney | 74/441 |
| 3,072,105 | 1/1963 | Johnson | 92/84 |
| 4,509,409 | 4/1985 | Reeves | 92/181 P |

FOREIGN PATENT DOCUMENTS

| | | | |
|---|---|---|---|
| 22186 | 7/1986 | Australia . | |
| 2338745 | 2/1975 | Fed. Rep. of Germany . | |
| 2701717 | 7/1977 | Fed. Rep. of Germany . | |
| 1035307 | 8/1983 | U.S.S.R. | 92/31 |

*Primary Examiner*—Robert E. Garrett
*Assistant Examiner*—Thomas Denion
*Attorney, Agent, or Firm*—Handal & Morofsky

[57] ABSTRACT

In a rotational working cylinder comprising a shaft arranged concentrically within the working cylinder and driven out of the working cylinder with at least one end of it, a piston being divided into two piston portions perpendicularly to the shaft and the piston portions being held in tensed position in respect to each other, forced trajectories between the working cylinder and the piston portions as well as between the piston portions and the shaft, respectively, at least one of the forced trajectories is formed as a longitudinal spiral path, and the piston portions are locked in relation to each other for maintaining the tensed position of the piston portions in all operational positions and loads of the working cylinder. Alternatively, a sealing plate is arranged between the two piston portions and the tensed position of the piston portions is established by the interconnection of the sealing plate, and the sealing plate has a middle opening and an outer periphery both being movable on the forced trajectories of the rotational working cylinder in a sealed manner, respectively.

6 Claims, 3 Drawing Sheets

ROTATIONAL WORKING CYLINDER

FIELD AND BACKGROUND OF THE INVENTION

The invention relates to a rotational working cylinder comprising a shaft arranged concentrically within the working cylinder and driven out of the working cylinder with at least one end of it, a piston being divided into two piston portions perpendicularly to the shaft and the piston portions being held in tensed position in respect to each other, forced trajectories between the working cylinder and the piston portions as well as between the piston portions and the shaft, respectively, wherein at least one of the forced trajectories is formed as a longitudinal spiral path.

In various fields of the industry, it is often required to provide rotary motion, including non-continuous rotation as well as displacement with a predetermined angular range. In particular cases, the rotary motion should be an alternating one with selectively opposite rotational directions. In these cases, large torques as well as small angular velocities can occur.

The best mode for fulfilling these needs is provided by a rotational ram cylinder as described in e.g. West-German Pat. No. 23 38 745. In the closed inner operating chamber of this ram cylinder are located a piston which is driven to move in alternating longitudinal motion by a hydraulic or pneumatic medium and a shaft being attached to the piston. At least one end of the shaft extends out of the operating chamber, and in this solution, at least one of the mechanical connections between the ram cylinder and the piston or between the piston and the shaft is formed as a spiral path rising in the longitudinal direction of the shaft.

However, in the praxis, it has been found that the backlash or play in these ram cylinders are too big for the applications in modern apparatuses such as in that of the robot technics. The clearence being necessary between the parts moving in respect to each other results in an insufficient accuracy of the convertion of the longitudinal motion of the piston into the rotational motion of the shaft.

The problems resulting from the insufficient accuracy have to be faced in the case of rotary converters having worm gears being previously more often used for movement conversion. Therefore, it has been suggested to divide the nut arranged on the worm spindle into two nut portions perpendicularly to the shaft as described e.g. in West-German Pat. No. 11 51 420 and West-German Pat. No. 27 01 717. In these solutions, the backlash is suggested to be lessened by holding the nut portions in tensioned position in respect to each other. For this, springs and magnet coils are arranged between the nut portions for tensioning them in respect to each other.

However, these solutions fail to work as awaited. The tensioned position can be maintained only in a relatively narrow load range because of the force of the springs and magnet coils which can be exerted between the nut portions. If this force is chosen to be big for carrying big loads by the worm gear, the threaded surfaces of the nut portions and the worm spindel are pressed on each other with a quite big normal force. This results in an enlargened frictional resistance when the surfaces have to be moved on each other and in an increased wear or abrasion of the threaded surfaces. The first deficiency necessitates a relatively high driving force, especially at the beginning of the relative movement between the threaded surfaces, and the second one causes a shorter endurance of the traditional rotary converters. If, in contrast, the force exerted between the nut portions is chosen to be small, the rotary converter can be used only for small loads since the smaller tensioning force can not withstand the forces urging one of the nut portions away from the threaded surface of the worm spindle. If this occures, the worm gear is no more free of backlash.

Further to this, the force exerted between the nut portions is dependent on the actual distance between the nut portions when using springs or magnet coils for making the worm gear free of the backlash. Therefore, the range of loads with which the traditional rotary converter can be operated changes in time since, depending on the wear of the constructional parts, the distance between the nut portions is varying. Followingly, if the rotary converter is faultless in one day, in the next it can have a backlash which can not be permitted, especially in robots. This makes the operational security of the known rotary converters insufficient.

Nevertheless, the rotary converters using worm gears have a lot of disadvantages as described in e.g. West-German Pat. No. 23 38 745 which are avoided with the solution as given in this patent. However, the elimination of the backlash in this kind of ram cylinders is not solved. This defficiency greatly limits the application possibilities of these modern rotational ram cylinders.

The main object of this invention is to eliminate the defficiencies of the above mentioned known solutions and to provide rotational working cylinder which is free of the backlash of the traditional rotational ram cylinders and which can be used for loads in a much wider range. Object of the invention is to provide an arrangement with which the load bearing capacity is not limited by the means provided for the elimination of the backlash but by other constructional features of the rotational working cylinder. Further object is to provide a construction which is easy and simple to manufacture and which has a sufficient operational security.

According to the improvement in this invention, the piston portions of the piston being divided into two portions are locked in relation to each other for maintaining the tensed position of the portions in all operational positions and loads of the working cylinder. The main importance of this solution is in that the backlash resulting from the necessary clearence between the piston and the cylinder as well as between the piston and the shaft remains eliminated during the whole operation cycle of the rotational working cylinder irrespective of the load to be carried by the working cylinder and of the direction and speed of rotation of the shaft of the working cylinder.

In a preferred embodiment, a locking means is provided between the piston portions for their locked relation and the locking means is operated by a hydraulic working agent of the rotational working cylinder.

In this case, it can be preferred when at least one cylinder hole formed as a blind hole and therein a piston are provided in each piston portion, and middle axes of the cylinder holes are on the same diameter around the shaft of the working cylinder, and the cylinder holes of the one piston portion are turned towards and are coaxial with the cylinder holes of the other piston portion, and the cylinder holes are connected through a bore to a working chamber of the rotational working cylinder with which the piston portion containing the cylinder hole is in contact, and the bore is closeable by a non-return valve, and the piston arranged slideably within the cylinder hole in a sealed manner has an inclined end surface in relation to the middle axis of the cylinder hole, and the inclined end surfaces of the pistons of the opposite cylinder holes are lain on each other. The non-return valve can be formed according to the invention as a ball arranged at an inner opening of the bore connecting the cylinder hole to the working chamber and the ball is loaded by a spring, an other end of which being lain on the piston of the cylinder hole.

In another preferred embodiment, at least one throughbore is provided in each piston portion which is closeable by a non-return valve permitting an inward flow of the working agent into a room provided between the piston portions. In this case, preferably, the through-bores arranged in face-to-face relation in the piston portions are coaxial and the non-return valves are formed as balls being pressed on an opening of the through-bores by a spring being a common one for the coaxial through-bores. Further to this, a throttle can be provided in the through-bore for regulating the speed of flow of the working agent.

In still another preferred embodiment of the working cylinder in this invention, at least one through-channel with a cylinder portion and an end chamber and a bore interconnecting the cylinder portion and the end chamber is provided in each piston portion, and a piston body having a piston sealingly movable in the cylinder portion of the through-channel, a head portion being in the end chamber and a piston rod interconnecting the piston and the head portion and being movable in the bore is arranged in each through-channel. Therein, advantageously, a spring is arranged between the head portion and the piston portion forcing the head portion out of the end chamber of the piston portion.

The objects as set forth hereinabove can be realized according to this invention also by an improvement, wherein a sealing plate is arranged between the two piston portions and the tensed position of the piston portions is established by the interconnection of the sealing plate, and the sealing plate has a middle opening and an outer periphery both being movable on the forced trajectories of the rotational working cylinder in a sealed manner, respectively. Not only the load bearing capacity and the operational range of the rotational working cylinder are enlargened with this improvement but also the manufacture is simpler and cheaper as well as the operational security is greater.

In a preferred embodiment, at least one through-bore being parallel to the shaft is arranged in each piston portion and the opposite through-bores are coaxial and a spring is fixed in every through-bore, an other end of which being fixed to the sealing plate. In this case also, a throttle can be provided in the through-bore for regulating the flow of the working agent into a room provided between the two piston portions.

In another preferred embodiment in this invention, at least one guiding rod fixed at its middle portion to the sealing plate is arranged in coaxially opposite bores of the piston portions, and an inner supporting flange is formed in each bore and a spring is arranged between the sealing plate and the flange as well as between the flange and the guiding rod, respectively, on both sides of the sealing plate. Advantageously, the guiding rod has threaded ends onto which nuts are attached for supporting the springs attached to the guiding rod.

It is also preferable when the sealing plate has a middle plate made of sealing material and two stiffener plates supporting the middle plate from both sides. Therein, it is made possible that the tensioning means providing the tensioned position of the piston portions are connected on both sides to the stiffener plates.

Further objects and details of this invention will be described hereinafter with reference to the accompanying drawings on the basis of exemplified embodiments. In the drawings,

DESCRIPTION OF THE PREFERRED EMBODIMENTS

Figure 1:
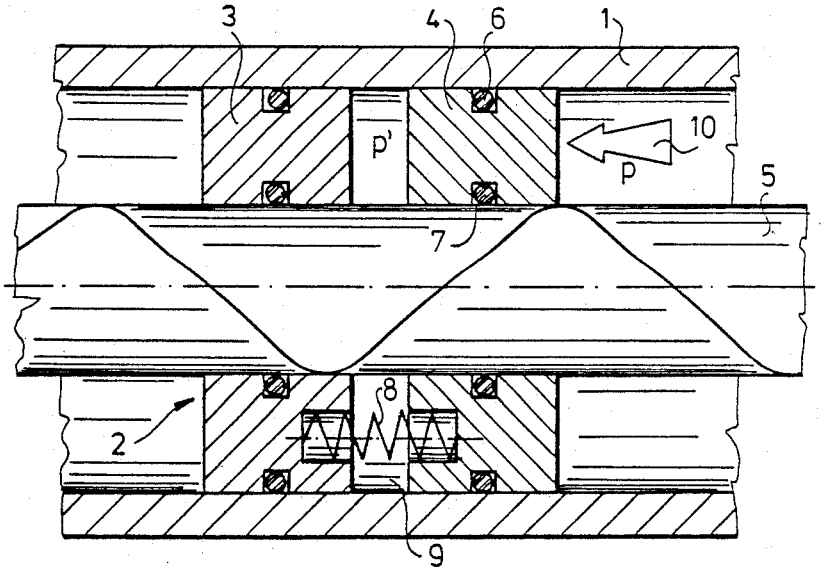
FIGS. 1 to 6 show various embodiments of the rotational working cylinder as in this invention in vertical cross section or part of it.

In Figures, parts of the cross section of preferred embodiments of the rotational working cylinder are shown. The portions of the working cylinder which are not shown in the drawings are formed as usual such as given in e.g. West-German Pat. No. 23 78 745. In a working cylinder 1, a piston 2 is arranged which is divided into two piston portions 3 and 4. The piston portions 3 and 4, a central shaft 5 runs through whose at least one end projects from the inner room of working cylinder 1. The division of piston 2 is made perpendicularly to the shaft 5, thus, piston portions 3 and 4 have parallel limiting surfaces perpendicularly to the longitudinal axis of working cylinder 1.

In the rotational working cylinder, forced trajectories are provided between the working cylinder 1 and the piston portions 3 and 4 as well as between the piston portions 3 and 4 and the shaft 5, respectively. Therefore, piston portions 3 and 4 are able to move in axial direction in working cylinder 1 but cannot perform angular twisting either relative to working cylinder 1 or relative to shaft 5. Further to this, the axial movement of piston portions 3 and 4 compels shaft 5 to make an angular twist relative to working cylinder 1. This movement of piston portions 3 and 4 is reached by the impact of a pressurized agent, preferably of a liquid medium such as hydraulic oil introduced into the operating chamber of working cylinder 1 under high pressure on both sides of the piston portions 3 and 4 as usual with traditional ram cylinders having a piston. This is not shown in the drawings.

As the praxis has shown, the most preferable form for providing the mentioned forced trajectories is to shape the internal surface of working cylinder 1 for having a perpendicular cross section of a regular polygon. The external casing surface of piston portions 3 and 4 is adapted to this profile. Shaft 5 can also be shaped for having a regular polygon cross section which can differ from the profile of working cylinder 1. The internal casing surface of piston portions 3 and 4 is adapted to this shaft profile.

In the embodiments shown in the Figures, the forced trajectory between cylinder portions 3 and 4 and shaft 5 is formed as a longitudinal path around the middle axis of shaft 5. In the case of regular polygon profiles, the spiral path can have a much greater pitch than the usual worm gears. In the embodiments shown in FIGS. 1 to 4, piston portions 3 and 4 are sealed against cylinder 1 as well as against shaft 5 with the aid of usual sealing rings 6 and 7.

In the sense of the invention, the piston portions 3 and 4 are held in tensed position in respect to each other. This can be realized by either pulling piston portions 3,4, towards each other or pushing them away from each other. For this, a spring 8 is arranged between piston portions 3 and 4 in FIG. 1. This spring 8 can be a compression one or a tension one. In both cases, piston portions 3 and 4 lay on cylinder 1 and shaft 5 without any backlash. For maintaining this position under all operational conditions, a room 9 between piston portions 3 and 4 is filled with the hydraulic working agent of cylinder 1. This is made possible by the leakage which occurs inavitably at sealing rings 6 and 7 in both piston portions 3 and 4.

If, in operation, the working agent is applied as shown by an arrow 10 with a pressure p, because of the leakage at sealing rings 6 and 7, a differential pressure p' is in room 9 impacting on the inner surface of piston portion 3 limiting room 9 on this side. The force resulting from this pressure p' and the force of spring 8 will hold piston portion 3 pressed on the forced trajectories at cylinder 1 as well as at shaft 5. Thus, if the direction of the application of the working agent is reversed, shaft 5 will rotate in the reversed direction without any backlash. If the pressure p of the working agent is increased, pressure p' in room 9 will also increase, thus, the tensed position of piston portions 3 and 4 in respect to each other will be maintained.

Figure 2:
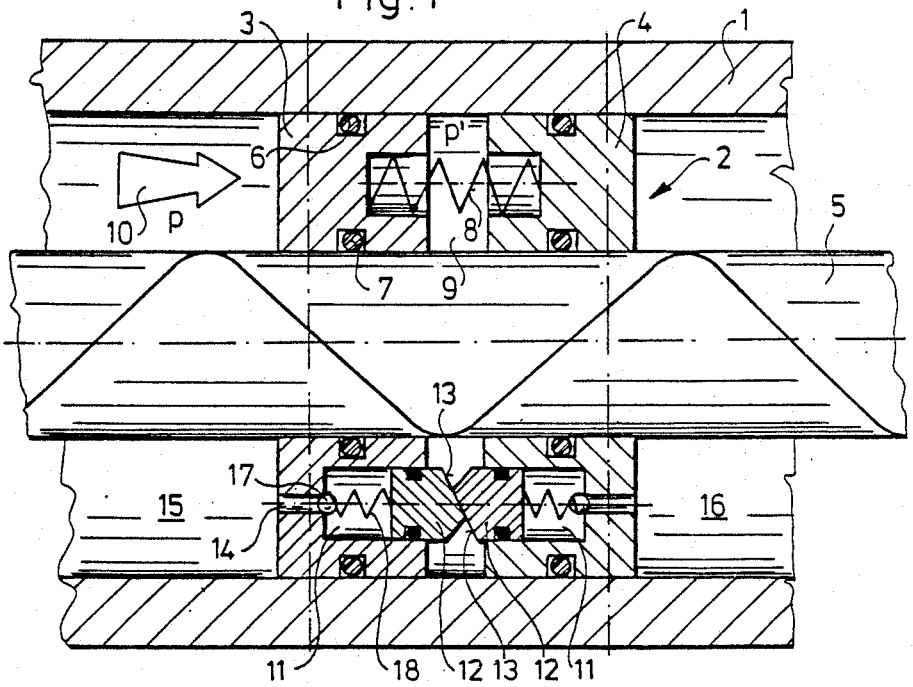

The effect of differential pressure p' in room 9 can be enhanced with the embodiment as shown in FIG. 2. Therein, at least one cylinder hole 11 formed as a blind hole is provided in piston portions 3, 4, respectively. In cylinder hole 11, a piston 12 is slidably arranged in a sealed manner. The cylinder hole 11 in piston portion 3 is turned towards cylinder hole 11 in piston portion 4 and vica versa. They are also coaxial as if they were parts of the same bore. The piston 12 arranged in cylinder hole 11 has an inclined end surface 13 the angle of which to the longitudinal axis of cylinder hole 11 is other than 90 degrees.

The cylinder hole 11 of each piston portion 3, 4, is connected through a bore 14 to working chamber 15, 16, respectively, with which piston portion 3, 4 is in contact. Bore 14 is closable by a non-return valve which is formed in this embodiment as a ball 17 pressed on the inner opening of bore 14 by a spring 18, the other end of which is lain on piston 12.

If there is more cylinder holes 11 than one pair of them, they are arranged on the same diameter around the shaft 5 but always pair-like as mentioned above. It is advantageous to arrange them in equidistantial manner on this diameter.

In operation, inclined end surface 13 of pistons 12 are lain on each other. If the working agent is applied as shown by arrow 10, its pressure opens the non-return valve in piston portion 3 by lifting ball 17 away from the inner opening of bore 14. Piston 12 cannot move further out from cylinder bore 11 since it lies on inclined end surface 13 of piston 12 of the other piston portion 4. When, in return, the pressure will be applied in reverse direction in working chamber 16, shaft 5 will rotate in reversed direction without any backlash since piston portions 3 and 4 are hold in tensed position because of pistons 12 pressed against each other. Nevertheless, the differential pressure p' in room 9 between piston portions 3 and 4 fulfill its function, too, as it is described in connection with FIG. 1.

Figure 3:
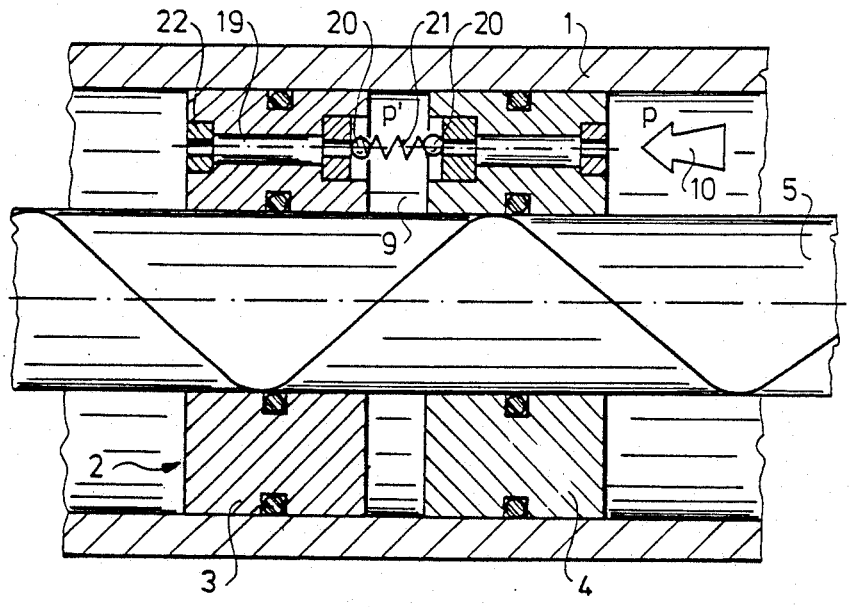

The embodiment as shown in FIG. 3 differs from the previous one by the construction of the locking means for maintaining the tensed position of the piston portions 3 and 4. Herein, at least one through-bore 19 is arranged in every piston portion 3, 4 which is closable by non-return valve permitting only the inward flow of the working agent into room 9 between piston portions 3, 4. Opposite throughbores 19 are also arranged in pairs as cylinder holes 11 in FIG. 2. The non-return valves are formed as balls 20 pressed on the inner openings of through-bores 19. For this, a common spring 21 is arranged between balls 20 of opposite through-bores 19.

Further to this, a throttle 22 is provided in throughbore 19 for determining the speed of flow of the working agent into room 9. With this and with dimensioning spring 21, the value of differential pressure p' can be varied. In this embodiment, too, piston portion 3 which is the second one seen in direction of pressure p of the working agent as shown by arrow 10 will move only when differential pressure p' is provided which, at the same time, holds piston portion 3 pressed on the forced trajectories and, thus, the backlash is eliminated for the whole operation.

Figure 4:
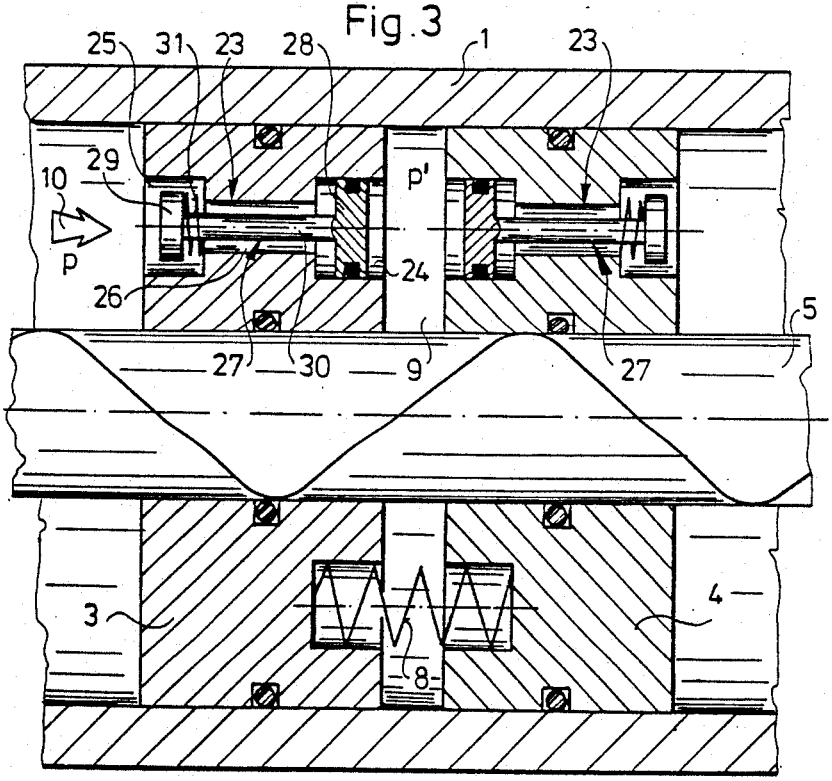

In the embodiment as shown in FIG. 4, at least one through-channel 23 is provided in every piston portion 3, 4 in the above mentioned pair-like arrangement. At one end of through-channel 23 on the inner side of piston portion 3, 4, a cylinder portion 24 and at the other end of throughchannel 23, an end chamber 25 are formed. Cylinder portion 24 and end chamber 25 are interconnected by a bore 26. In through-channel 23, a piston body 27 having a piston 28 and head portion 29 as well as a piston rod 30 interconnecting piston 28 and head portion 29 is arranged. Piston 28 of piston body 27 is sealingly slidable in cylinder portion 24 and head portion 29 is freely movable in end chamber 25. Piston rod 30 extends through bore 26.

In this embodiment, a spring 31 is arranged between head portion 29 and piston portion 3, 4 which tends to push out head portion 29 from end chamber 25 and, at the same time, to pull in piston 28 into cylinder portion 24.

In operation of this embodiment, spring 8 move away piston portions 3 and 4 until they impact on the forced trajectories. Room 9 between piston portions 3 and 4 is filled with working agent. Operational pressure p (arrow 10) impacts on head portion 29 and, from this side, on piston 28, too, which enlarges the differential pressure p' in room 9. As the result of forces of pressure p' and spring 8, piston portion 4 will be moved and piston portion 3 follows this movement without backlash. When direction of the operational pressure p is reversed, piston portion 3 moves as described above and piston portion 4 follows this movement without backlash. In this way, the tensed position of piston portions 3 and 4 is maintained during the whole operation of the rotational working cylinder.

As is mentioned above, the load bearing capacity of the previously described embodiments in this invention is not limited by the means holding the piston portions 3 and 4 in tensed position in respect to each other. However, in the praxis, a kind of limit is to be taken into consideration because of the loadability of the sealing arrangements, e.g. sealing rings 6, 7 in piston portions 3, 4. Further to this, it is quite complicated to manufacture piston portions 3 and 4 if sealing rings 6, 7 have to be arranged therein. With respect to these features, further embodiments of the rotational working cylinder as in this invention are shown in FIGS. 5 and 6.

Figure 5:
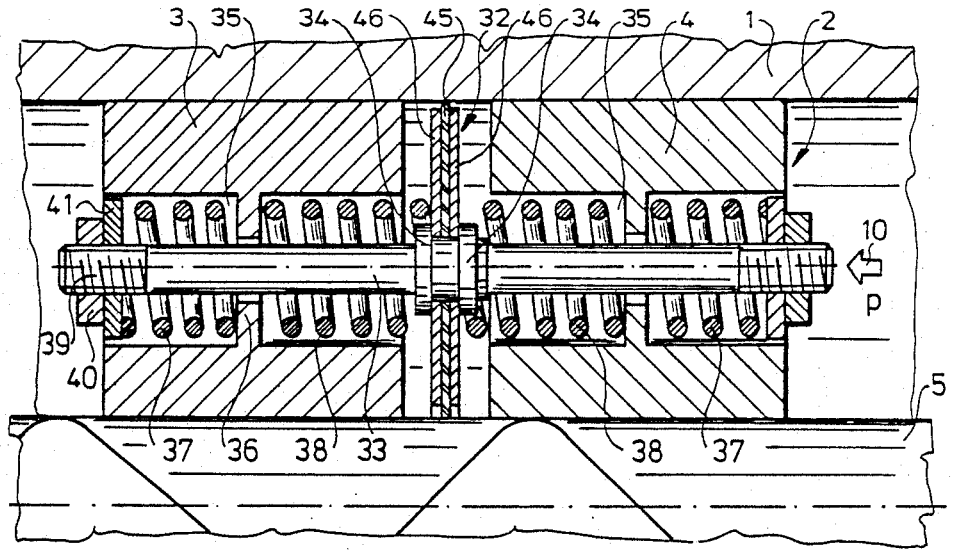
Figure 6:
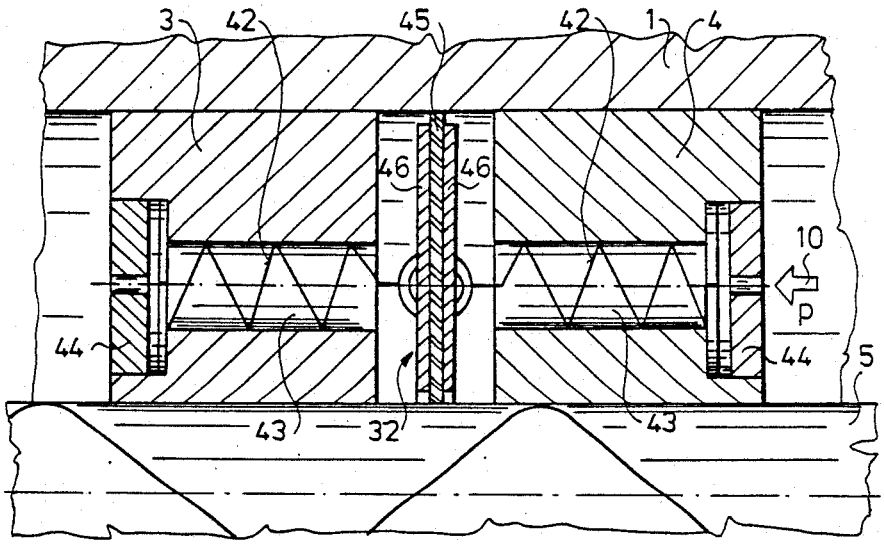

In FIG. 5, piston 2 in cylinder 1 is also divided into two portions 3, 4, between which a sealing plate 32 is arranged. In the sense of the invention, the tensed position of piston portions 3, 4 in relation to each other is provided by the interconnection of sealing plate 32. For realizing this, at least one guiding rod 33 is fixed at its middle to sealing plate 32 for holding it perpendicularly to the longitudinal axis of cylinder 1. In this example, two rings 34 are fixed on both sides of sealing plate 32 between which sealing plate 32 is held stiffly on guiding rod 33.

For receiving guiding rod 33, a bore 35 is formed in each piston portions 3, 4 in pair-like arrangement wherein the opposite bores 35 are coaxial. In the middle region of every bore 35, an inner flange 36 is provided which lets through guiding rod 33 but supports a spring 37 and 38, on both sides, respectively. One of the springs 37 is connected with its other end to guiding rod 33. For this, guiding rod 33 has threaded ends 39 onto which a nut 40 is attached, for supporting spring 37 by the intervention of a washer 41 on both ends of guiding rod 33, respectively. Other spring 38 being also supported by flange 36 lies on sealing plate 32, on both sides, respectively.

In the embodiment as shown in FIG. 5, springs 38 are pre-stressed and springs 37 are in neutral position without any pre-stress when the rotational working cylinder is not in operation. Then, sealing plate 32 is in middle position as shown in FIG. 5.

In operation, pressure p is applied e.g. as shown by arrow 10. Sealing plate 32 will move to the left in the drawing and spring 38 on the left side of sealing plate 32 will further be compressed. At the same time, right hand spring 37 will also be compressed since guiding rod 33 moves with sealing plate 32 to the left and nut 40 and washer 41 move with it. As a result of this, piston portion 3 will be pushed to the left by spring 38 and piston portion 4 will be tracted by spring 37 without any delay or backlash. In this way, spring 37 works against the force of spring 38 when guiding rod 33 is moved by sealing plate 32. Accordingly, the spring characteristics are to be chosen with regard, among others, to the dimensions of the working cylinder and the load which is to be carried.

In FIG. 6, a spring 42 is fixed to both sides of sealing plate 32, respectively. Other ends of springs 42 are attached to piston portions 3, 4, respectively. Springs 42 are arranged in bores 43, at least one of which is formed in each piston portion 3, 4. Opposite bores 43 are in pairlike arrangement. Further to this, at the outer ends of bores 43, a throttle 44 is arranged in each piston portion 3 and 4.

In operation of this embodiment, pressure p shown by arrow 10 is applied onto sealing plate 32 and the outer surface of piston portion 4. The ratio of the pressure impacting on piston portion 4 to the pressure impacting on sealing plate 32 is determined by the measurement of throttle 44. As a result of these pressures and the forces of springs 42, piston portion 3 will move to the left and piston portion 4 will follow this without any delay or backlash. Followingly, shaft 5 will rotate into the reversed direction without any backlash when the direction of operational pressure p is changed.

In both embodiments in FIGS. 5 and 6, the outer form of the periphery of sealing plate 32 follows the form of the forced trajectory on the inner limiting surface of cylinder 1. Accordingly, the form of the middle bore of sealing plate 32 accommating shaft 5 is the same as that of the forced trajectory on the outer limiting surface of shaft 5.

It is a quite simple embodiment of sealing plate 32 wherein a middle plate 45 made of a material having good sealing characteristics and wearing stability is surrounded from both sides by stiffener plates 46 supporting middle plate 45. In this case, springs 38 or 42 can be attached to stiffener plates 46.

We claim:

1. A fluid-operated working cylinder comprising:

(a) a shaft within, and coaxial with, said working cylinder, one end of said shaft extending out of said cylinder;

(b) two piston portions also within, and coaxial with, said cylinder and matingly engaging with, and moveable with respect to both the interior surface of said cylinder and the exterior surface of said shaft, said shaft passing through central holes in said piston portions dimensioned and configured to accommodate said shaft;

(c) a sealing plate between said piston portions within, and coaxial with, said cylinder, comprising a middle plate made of a sealing material and two stiffener plates supporting the middle plate, said sealing plate bearing sealingly against, but moveable with respect to said interior surface of the cylinder and said exterior surface of the shaft passing through a central hole in said sealing plate;

(d) interconnection means holding said piston portions in a tensed position; and (e) forced trajectories between said cylinder and both the sealing plate and said piston portions and between both the sealing plate and said piston portions and the shaft, respectively, wherein one of said trajectories is formed as a longitudinal spiral path.

2. A rotational fluid-operated working cylinder as claimed in claim 1, wherein tensioning means providing the tensioned position of the piston portions are connected on both sides to the stiffener plates.

3. A fluid-operated working cylinder comprising:

(a) a shaft within, and coaxial with, said working cylinder, one end of said shaft extending out of said cylinder;

(b) two piston portions also within, and coaxial with, said cylinder and matingly engaging with, and moveable with respect to both the interior surface of said cylinder and the exterior surface of said shaft, said shaft passing through central holes in said piston portions dimensioned and configured to accommodate said shaft;

(c) a sealing plate between said piston portions within, and coaxial with, said cylinder, said sealing plate bearing sealingly against, but moveable with respect to said interior surface of the cylinder and said exterior surface of the shaft passing through a central hole in said sealing plate;

(d) interconnection means holding said piston portions in a tensed position, wherein a through-bore, parallel to said shaft, is arranged in each piston portion such that the through-bore in one piston portion is opposite, and coaxial with, the through-bore in the other piston portion and a spring is fixed at one end in each of said through-bores, the other end of said springs being fixed to the sealing plate between said piston parts; and (e) forced trajectories between said cylinder and both the sealing plate and said piston portions and between both the sealing plate and said piston portions and the shaft, respectively, wherein one of said trajectories is formed as a longitudinal spiral path.

4. A rotational working cylinder as in claim 3, wherein a throttle is provided in the through-bore for regulating the flow of the working agent into a room provided between the two piston portions.

5. A fluid-operated working cylinder comprising:

(a) a shaft within, and coaxial with, said working cylinder, one end of said shaft extending out of said cylinder;

(b) two piston portions also within, and coaxial with, said cylinder and matingly engaging with, and moveable with respect to both the interior surface of said cylinder and the exterior surface of said shaft, said shaft passing through central holes in said piston portions dimensioned and configured to accommodate said shaft;

(c) a sealing plate between said piston portions within, and coaxial with, said cylinder, said sealing plate bearing sealingly against, but moveable with respect to said interior surface of the cylinder and said exterior surface of the shaft passing through a central hole in said sealing plate;

(d) interconnection means holding said piston portions in a tensed position, wherein at least one guiding rod, fixed at its middle portion to the sealing plate, is arranged in coaxially opposite bores of the piston portions, and an inner supporting flange is formed in each bore and a spring is arranged between the sealing plate and the flange as well as between the flange and the guiding rod, respectively, on both sides of the sealing plate.; and (e) forced trajectories between said cylinder and both the sealing plate and said piston portions and between both the sealing plate and said piston portions and the shaft, respectively, wherein one of said trajectories is formed as a longitudinal spiral path.

6. A rotational working cylinder as in claim 5, wherein the guiding rod has threaded ends onto which nuts are attached for supporting the springs attached to the guiding rod.

* * * * *